United States Patent [19]

Fabian et al.

[11] Patent Number: 4,674,309

[45] Date of Patent: Jun. 23, 1987

[54] APPARATUS FOR CORRECTING THE THICKNESS PROFILE OF A STRIP TO BE ROLLED IN A MULTIPLE STAND HOT STRIP MILL TRAIN

[75] Inventors: Wolfgang Fabian; Hermann J. Kopineck; Wilhelm Tappe, all of Dortmund, Fed. Rep. of Germany

[73] Assignee: Hoesch Stahl Aktiengesellschaft, Fed. Rep. of Germany

[21] Appl. No.: 774,819

[22] Filed: Sep. 11, 1985

[30] Foreign Application Priority Data

Sep. 26, 1984 [DE] Fed. Rep. of Germany ..... 3435232

[51] Int. Cl.[4] ..... B21B 37/06

[52] U.S. Cl. ..... 72/9; 72/12; 72/17; 72/234

[58] Field of Search ..... 72/17, 8, 9–12, 72/234, 243, 20

[56] References Cited

U.S. PATENT DOCUMENTS 3,613,417 10/1971 Woodburn ..... 72/8
4,262,511 4/1981 Boisvert et al. ..... 72/17

FOREIGN PATENT DOCUMENTS 0076150 7/1978 Japan ..... 72/17
0209708 12/1982 Japan ..... 72/17

*Primary Examiner*—Robert L. Spruill
*Assistant Examiner*—Steve Katz

[57] ABSTRACT

A method and apparatus for a very exact correction of the thickness profile of strip rolled in a multi-stand hot strip mill. A measuring device determines the distribution of tensions in the cross-section of the strip (19). The measuring values are processed in a computer (32) to manipulated variables for a swinging or tilting device and a roll bending device (42). The roll bending device (42) is installed at the end of a hot strip mill train, and one or several roll swinging or tilting devices with measuring devices are provided, as seen in rolling direction, before the roll bending device (42).

6 Claims, 3 Drawing Figures

APPARATUS FOR CORRECTING THE THICKNESS PROFILE OF A STRIP TO BE ROLLED IN A MULTIPLE STAND HOT STRIP MILL TRAIN

Method and apparatus for correcting the thickness profile of a strip to be rolled in a multiple stand hot strip mill train.

BACKGROUND OF THE INVENTION

The invention relates to a method and apparatus for correcting the thickness profile of the strip to be rolled in a multiple-stand hot strip mill train.

Several devices are known with which the shape of the roll gap and thus the thickness profile of the strip to be rolled can be changed. There are roll stands where the upper roll can be swung somewhat so that a small rotation occurs around an imaginary axis extending horizontally through the center of the roll and lying 90° relative to the roll axis. Such a device is used for plane level controlling.

Devices are also known with which the shape of the roll is somewhat changed in that the roll or its bearings are somewhat bent opposite the roll setting means by hydraulic means at both ends. This bending is necessary at the edges because the roll would otherwise roll the strip flatter at the edges than in the middle, since the edges have a stronger flow under roll pressure than the center of the strip.

These two known correcting devices have been used up to now for making rough adjustments for faults which arose due to wear and whose extent was indicated periodically at the finished, rolled strip by conventional measuring methods.

Changes with faster effect were only possible so far in case of a non-plane strip, e.g. when the strip forms waves at one side. This was immediately visible to the operating personnel. The wave shape at one side always comes about when this side has been rolled too strongly. In this case the sheet becomes longer and forms waves. In case of wave forming, the operator had to increase the roll gap at one of the roll stands by pivoting one roll at the side where the wave shape forms.

This regulation of a one-sided wave shape can be carried out automatically and very fast by installing a measuring device for measuring the roll tensions distributed over the width of the band, as is known from U.S. Pat. No. 4,116,029.

With these known methods and means for correcting the shape of the roll gap, only rough irregularities can be removed, because the center line of the strip does not always correspond with the center of the mill train and the strip constantly changes its position obliquely to the center line of the roll train. Sometimes the fluctuations are so great that the strip runs laterally against the limits of the roll train which badly interrupts the manufacturing process.

It is an object of the invention to reduce considerably the lateral, oblique fluctuations of the strip which occur in the direction of movement of the strip and to provide fast-acting, exact correction possibilities of the thickness profile by changing the roll gap.

SUMMARY OF INVENTION

An exact symmetrical position of the center of the strip to the center of the roll train is attained at the input of the roll train by known mechanical lateral guide means. At the input of the roll train the material to be rolled can be guided well laterally because it is still very thick. Within the roll train which consists of about 7 roll stands, the strip cannot be guided by lateral guide means any longer since the forces which act upon the strip are very great and the strip is already rolled flat, particularly at the last roll stands, which leads to one missing edge, capable of taking up strong lateral forces.

It has been found that a strip coming axially into the roll train, also leaves it again symmetrically relative to the center when all roll stands operate without fault. This, however, is not the case in practice. When only one roll at one side exerts a greater presssure than on the other side, the strip at the side with the roll gap which is too narrow, extends so that it becomes slightly curved and deviates at its center from the center of the roll train. Such deviations can be determined by measuring devices according to U.S. Pat. No. 4,116,029 for quickly finding the distribution of tensions obliquely to the strip. By means of minor swinging or tilting of a roll in the stand before or behind the measuring device, the deviation can be removed.

The measuring device and the swinging device were originally developed for the equalization of a non-plane strip. In case of a well-adjusted mechanical guide system at the input of the roll train the surprising observation was made that the measuring device and the swinging device can be used for exact central guiding of the strip within the roll train. An exact central guiding is important for all subsequent correcting devices because their effect is symmetrical to the center of the roll train. It is advisable to provide, distributed over the roll train, more than one measuring device coupled with a roll swinging or tilting device for exact central guiding.

The manipulated variables for correcting the roll gap are determined in a computer which also contains the comparator for the measuring values.

The same deviations in the measured values do not always give the same manipulated variables. With the aid of a suitable program, the computer takes into consideration e.g. the roll measurements, the width of the material to be rolled, the roll camber, the rolling force and the temperature of the strip, for the purpose of determining a manipulated variable.

DETAILED DESCRIPTION OF PREFERRED EMBODIMENTS

Figure 1:
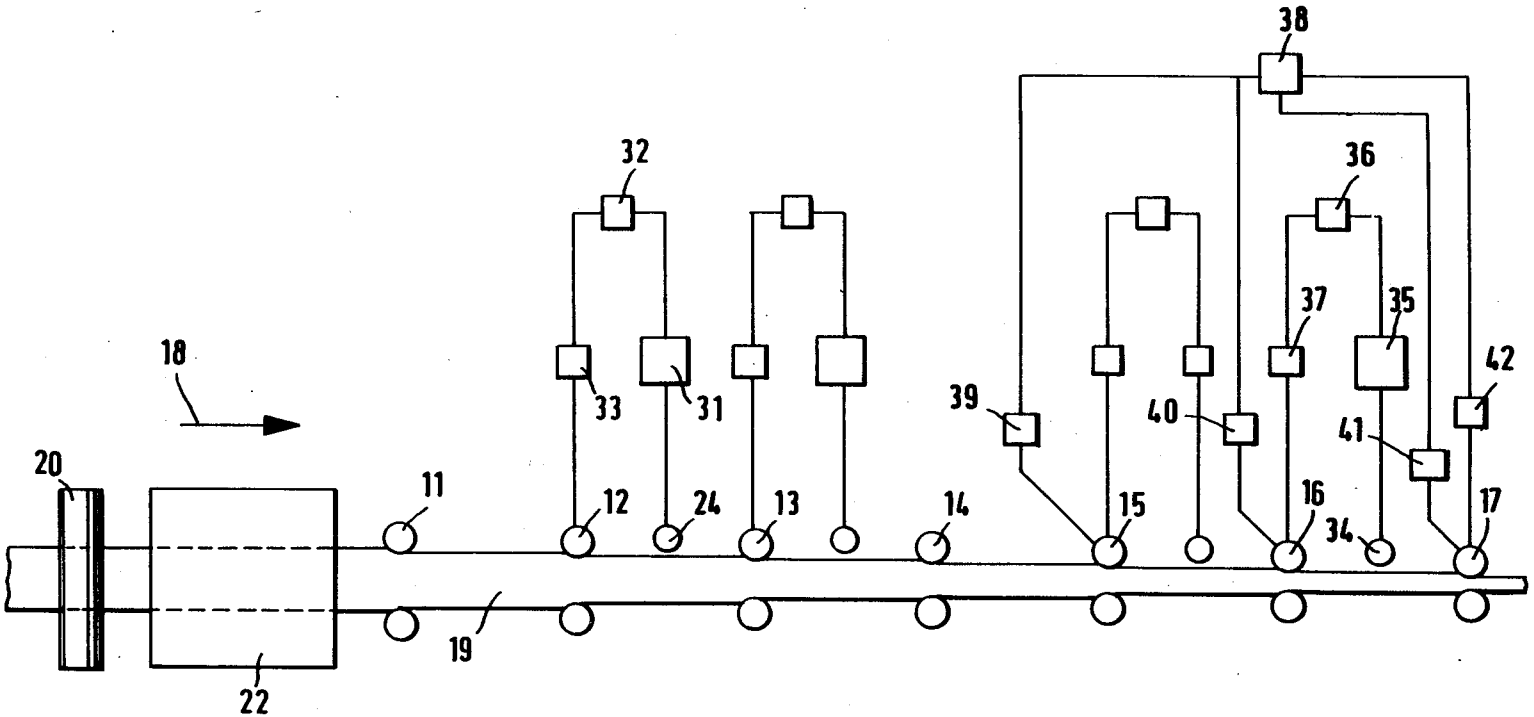
In FIG. 1 the entire rolling trail is shown in side elevation.
Figure 2:
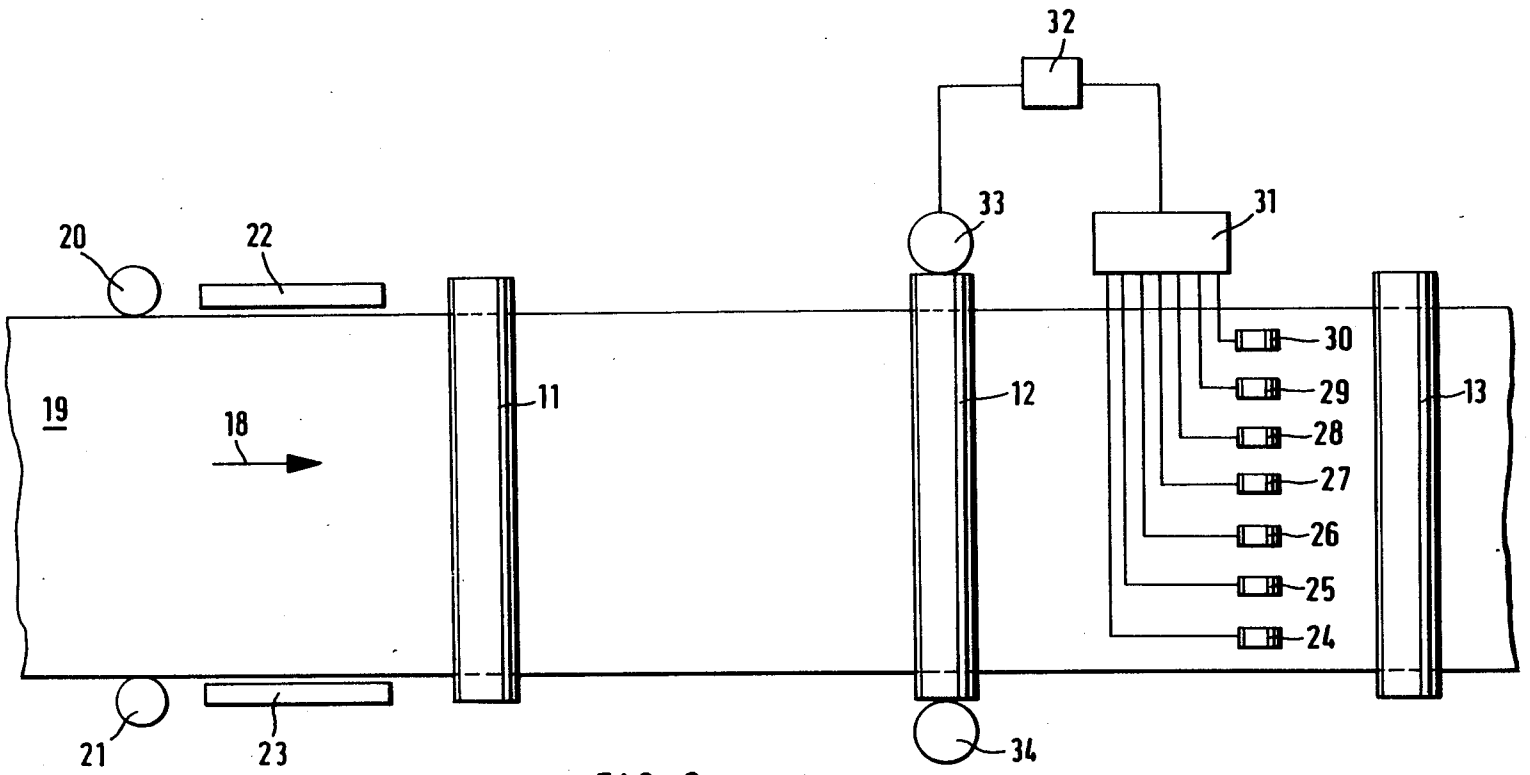
FIG. 2 shows a plan view of the input portion of the rolling mill.

The roll stands are indicated by numerals 11 to 17. Arrow 18 gives the input direction of the rolling stock or strip 19. This is first led by the rolls 20 and 21 and by the slide guides 22 and 23 exactly in the center of the rolling train before the first stand 11. If a deviation arises after passing of the first two stands 11 and 12, it will be determined by the measuring rolls 24 to 30 of the measuring device 31 in form of different tensions in the strip. These measuring results are compared in the computer 32. It calculates a manipulated variable which takes effect upon a control with, for example, hydraulic adjustment setting 33 and 34 on the upper roll of the roll stand 12, whereby this roll is somewhat tilted or swung around its center. It is also possible to provide a measuring device in this place which gives only signals of two measuring value indicators instead of the roll 24 and 30.

A measuring device of the same kind is also provided between the roll stands 13 and 14 for correcting the center positioning of the strip 19. Before the last roll stand 17, behind the capstan (not shown), a set of measuring rolls 24 to 30 of the same kind is installed, the outer one of which is indicated by 34. These measuring rolls give their values via the measuring device 35 to the computer 36. It calculates a manipulated variable for the control of the hydraulic roll bending device 37 which takes effect upon the upper roll of the roll stand 16.

An arrangement of the same kind can also be provided between the stands 15 and 16 which are effective upon the setting means of the stand 15.

Moreover, a computer 38 is installed into which the rolling data of the three last stands 15,16, 17, and especially the data of the rolling force from the force measuring devices 39,40 and 41, are introduced. This computer calculates a manipulated variable for controlling the hydraulic roll bending device 42 which is arranged in the stand 17.

Figure 3:
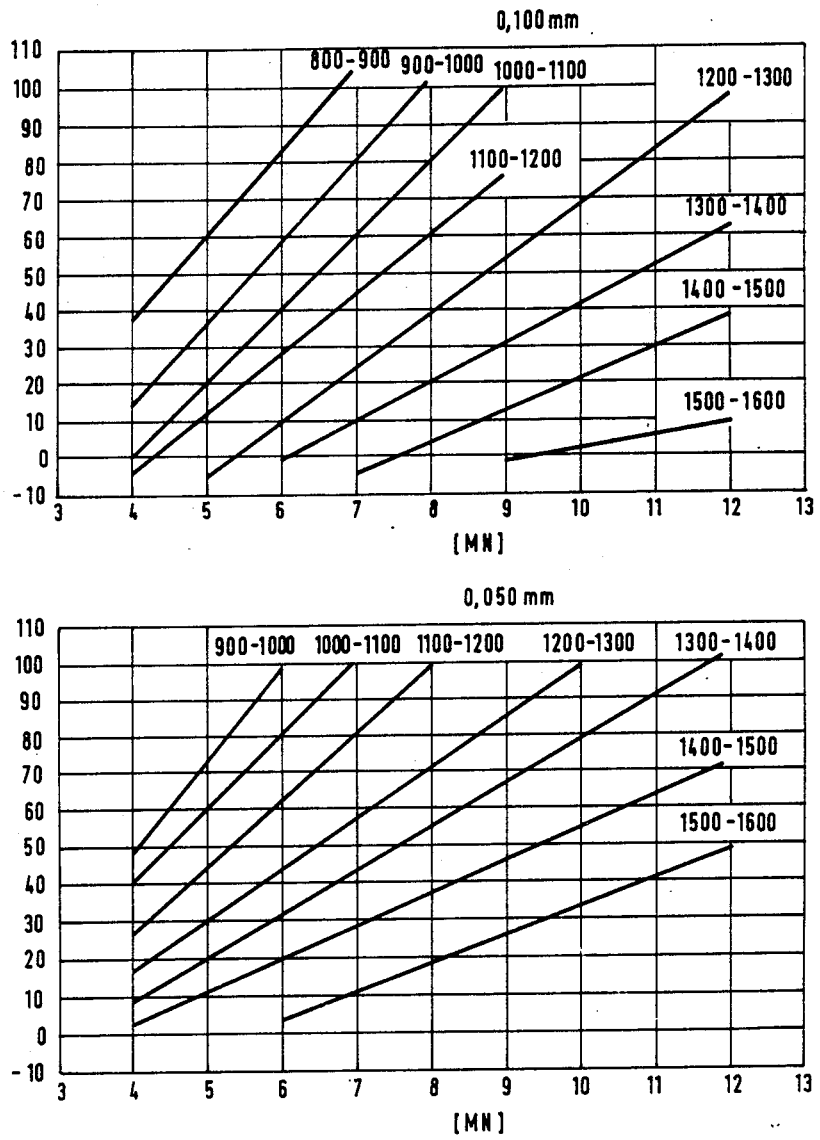
FIG. 3 shows curves illustrating rolling forces, crown in the working rollers etc.

As an example, FIG. 3 shows curves of values calculated by the computer 38, indicating the interconnection of the rolling force in the stand 17, the amount of crown in the working rollers, the width of the rolled band 19 with the setting for the roll bending to be calculated.

The values between 800 and 1.600 at the straight lines represent the band widths.

What is claimed is:

1. Apparatus for correcting the thickness profile of a strip to be rolled in a multiple stand hot strip rolling mill; said apparatus comprising at least two similar measuring devices installed respectively between pairs of roll stands, each of said measuring devices including means for measuring tension in the strip over a series of zones spaced across the strips, at least one roll tilting device at one roll stand for tilting at least one roll about a horizontal axis, comparison and control means receiving signals from one of said measuring devices associated with said one roll stand and operable to cause said tilting device to tilt said roll as required to center the strip passing through said roll stand, a roll bending device associated with a roll stand downstream of said one roll stand and operable selectively to increase and decrease the roll gap at the center of the rolls relative to the gap at the ends of the rolls, and additional comparison means receiving signals from said other measuring device and controlling the operation of said bending device.

2. Apparatus according to claim 1, characterized in that the roll bending device is installed in one of the lastthree roll stands of the mill.

3. Apparatus according to claim 1, characterized in that more than one roll bending device with an associated measuring device for measuring the distribution of tension is provided.

4. Apparatus according to claim 1, characterized in that the associated measuring devices are arranged, as seen in the direction of rolling, directly before or after the roll stand with whose swinging or bending device it is connected.

5. Apparatus according to claim 1, characterized in that the roll of the tilting device is tiltable around an imaginary axis extending along the center of the roll track and going through the center of the roll.

6. Apparatus according to claim 1, characterized in that the associated measuring device for measuring the distribution of tensions on the strip, lies, as seen in the direction of rolling, directly behind the roll stand, with the tilting and bending device with which it is connected, and in that roll force setting devices of the latter two stands are connected with the roll bending device of the last stand.

* * * * *